US011533797B2

(12) United States Patent
Zheng et al.

(10) Patent No.: US 11,533,797 B2
(45) Date of Patent: Dec. 20, 2022

(54) SINGLE-FIRE-WIRE TRIAC WIRELESS SMART DIMMER

(71) Applicant: Zhuhai Shengchang Electronics Co., Ltd., Zhuhai (CN)

(72) Inventors: Dehua Zheng, Zhuhai (CN); Xidi Xie, Jieyang (CN)

(73) Assignee: Zhuhai Shengchang Electronics Co., Ltd., Zhuhai (CN)

( * ) Notice: Subject to any disclaimer, the term of this patent is extended or adjusted under 35 U.S.C. 154(b) by 0 days.

(21) Appl. No.: 17/560,185

(22) Filed: Dec. 22, 2021

(65) Prior Publication Data

US 2022/0330408 A1 Oct. 13, 2022

(30) Foreign Application Priority Data

Apr. 7, 2021 (CN) ..... 202110370765.4
Apr. 7, 2021 (CN) ..... 202120698926.8

(51) Int. Cl.
*H05B 47/19* (2020.01)
*H05B 45/50* (2022.01)
*H05B 45/10* (2020.01)

(52) U.S. Cl.
CPC ..... *H05B 47/19* (2020.01); *H05B 45/10* (2020.01); *H05B 45/50* (2020.01)

(58) Field of Classification Search
CPC .... H05B 45/10; H05B 45/3725; H05B 47/10; H05B 47/25; H05B 39/044; H05B 45/355; H05B 45/31; H05B 45/325; H05B 45/36; H05B 45/20; H05B 45/315; H05B 45/3575; H05B 45/382; H05B 45/39; H05B 45/395; H05B 45/44; H05B 45/59; H02M 1/007; H02M 1/081; H02M 1/126; H02M 1/4208; H02M 1/44; H02M 3/33523; H02M 5/257; H02M 5/293
See application file for complete search history.

(56) References Cited

U.S. PATENT DOCUMENTS

| | | | | |
|---|---|---|---|---|
| 9,837,928 | B1 * | 12/2017 | Wang | H02M 5/257 |
| 9,961,724 | B1 * | 5/2018 | Zheng | H05B 45/31 |
| 10,039,167 | B1 * | 7/2018 | Zheng | H05B 45/10 |
| 10,716,179 | B1 * | 7/2020 | Wang | H05B 45/37 |
| 2019/0373692 | A1 * | 12/2019 | Zheng | H05B 45/3725 |
| 2020/0305254 | A1 * | 9/2020 | Zheng | H05B 47/25 |
| 2021/0392729 | A1 * | 12/2021 | Zheng | H05B 45/325 |

* cited by examiner

*Primary Examiner* — Monica C King
(74) *Attorney, Agent, or Firm* — Georgi Korobanov

(57) ABSTRACT

A single-fire-wire TRIAC wireless smart dimmer includes a single-fire-wire input device, a single-fire-wire output device, an AC/DC circuit, a bridge rectifier, a frequency/zero point detection circuit, a chopped-wave dimming circuit, an overload protection circuit, a single chip microcomputer minimum system, an input device, a brightness display circuit, a minimum chopped-wave value setting circuit, a chopped-wave phase selection circuit, and a RF transceiver circuit. A single-fire-wire power taking method is used to maintain the normal operation of the dimmer and overcome the issue of insufficient current for the wireless transmission/receiving operations. The dimmer is capable of automatically distinguishing and adapting an alternating current of 50 HZ or 60 HZ, selecting the phase of a leading edge or trailing edge chop wave, providing better control of compatible power supplies, setting minimum chop wave value, providing overload protection, and displaying brightness percentage.

2 Claims, 14 Drawing Sheets

SINGLE-FIRE-WIRE TRIAC WIRELESS SMART DIMMER

FIELD OF THE INVENTION

The present invention relates to a single-fire-wire power taking, wireless TRIode AC semiconductor switch (TRIAC) dimming control technology, and more particularly to a single-fire-wire TRIAC wireless smart dimmer capable of maintaining the power supply and wireless control of the whole dimmer.

BACKGROUND OF THE INVENTION

With the development of the light emitting diode (LED) technologies, new TRIAC dimming products are introduced into the market continuously. At the same time, a higher specification of the TRIAC dimmers is required, and the single-fire-wire power taking wireless control dimmers will be a development trend in the future.

At present, most TRIAC dimming products on the market generally have one or more of the following problems:

1. The TRIAC control solution of these products only allows the leading edge phase cut dimming.
2. These products do not provide an option of leading edge dimming or trailing edge dimming, which is not good enough for the compatibility of the dimmable lamps.
3. These products do not incorporate the single-fire-wire power taking method in a single-in-single-out wiring manner.
4. These products cannot automatically distinguish an alternating current of 50 HZ or 60 HZ (The utility power of some foreign countries is of 50 HZ or 60 HZ);
5. These products do not provide the overload protection function;
6. These products cannot set the minimum brightness value.
7. These products do not display the current brightness percentage;
8. These products do not implement the single-fire-wire power taking for the wireless control.

In summation, most of the conventional TRIAC dimming products on the market do not provide the single-fire-wire power taking function or the wireless control of dimming, and thus this invention provides a single-fire-wire TRIAC wireless smart dimmer to overcome the deficiencies of the conventional dimmers.

SUMMARY OF THE INVENTION

It is a primary objective of the invention to overcome the deficiencies of is the prior art by providing a single-fire-wire TRIAC wireless smart dimmer in accordance with the present invention.

To achieve the aforementioned and other objectives, the present invention discloses a single-fire-wire TRIAC wireless smart dimmer that includes a single-fire-wire input device, a single-fire-wire output device, an AC/DC circuit, bridge rectifier, a frequency/zero point detection circuit, a chopped-wave dimming circuit, an overload protection circuit, a single chip microcomputer minimum system, an input device, a brightness display circuit, a minimum chopped-wave value setting circuit, a chopped-wave phase selection circuit, and a RF transceiver circuit. The single-fire-wire input device is connected to the bridge rectifier; the single-fire-wire output device is connected to the overload protection circuit; the AC/DC circuit is connected to the bridge rectifier, the overload protection circuit, the single chip microcomputer minimum system, the input device, the brightness display circuit, the minimum chopped-wave value setting circuit, the chopped-wave phase selection circuit, and the RF transceiver circuit; the bridge rectifier is connected to the frequency/zero point detection circuit and the chopped-wave dimming circuit; the frequency/zero point detection circuit is connected to the single chip microcomputer minimum system; the chopped-wave dimming circuit is connected to the overload protection circuit and the single chip microcomputer minimum system; the overload protection circuit is connected to the single chip microcomputer minimum system, the input device, the brightness display circuit, the minimum chopped-wave value setting circuit, the chopped-wave phase selection circuit and the RF transceiver circuit; and the single chip microcomputer minimum system is connected to the input device, the brightness display circuit, the minimum chopped-wave value setting circuit and the chopped-wave phase selection circuit, RF transceiver circuit.

Both of the single-fire-wire input device and the single-fire-wire output device are applicable to an alternating current of 50 HZ or 60 HZ, and the bridge rectifier includes a rectifier pile or a diode capable of converting the alternating current of 50 HZ or 60 HZ from a sine wave into a square wave, and the AC/DC circuit supplies the working power to the dimmer and includes an integrated AC/DC chip or a discrete component to achieve an AC/DC function, and the frequency/zero point detection circuit is provided for distinguishing the frequency of the inputted alternating current and determining a zero-crossing point and has a high/low level or ADC detection function, and the chopped-wave dimming circuit includes a MOS or an IGBT which is a chopped-wave dimming circuit with the TRIAC part, and the overload protection circuit is a protection circuit provided for preventing the dimmer from being overloaded and includes a high/low level or ADC detector, and the single chip microcomputer minimum system is provided for obtaining, calculating, processing and controlling data, and the input device is provided for inputting an operation and includes a button module or a touch module, and the brightness display circuit is provided for displaying the current brightness percentage, and the minimum chopped-wave value setting circuit includes a switch dial or a potentiometer capable of setting a minimum chop wave value, and the chopped-wave phase selection circuit includes a switch dial or a potentiometer for selecting the phase of a leading edge chop wave or a trailing edge chop wave, and the RF transceiver circuit includes an infrared, Bluetooth, or wireless transmitting and receiving smart control.

This invention has the following advantageous effects: Since this invention includes a single-fire-wire input device, a single-fire-wire output device, an AC/DC circuit, a bridge rectifier, a frequency/zero point detection circuit, a chopped-wave dimming circuit, an overload protection circuit, a single chip microcomputer minimum system, an input device, a brightness display circuit, a minimum chopped-wave value setting circuit, a chopped-wave phase selection circuit, and a RF transceiver circuit, therefore this invention can use the single-fire-wire power taking method to maintain the normal operation of the dimmer and overcome the issue of supplying insufficient current for the wireless transmission/receiving operations. The dimmer is capable of selecting the phase of a chop wave (such as a leading edge chop wave or a trailing edge chop wave), providing better control of compatible power supplies, setting minimum chop wave value, providing overload protection, and displaying brightness percentage.

DESCRIPTION OF THE PREFERRED EMBODIMENTS

This invention will become clearer in light of the following detailed description of an illustrative embodiment of this invention described in connection with the drawings.

Figure 1:
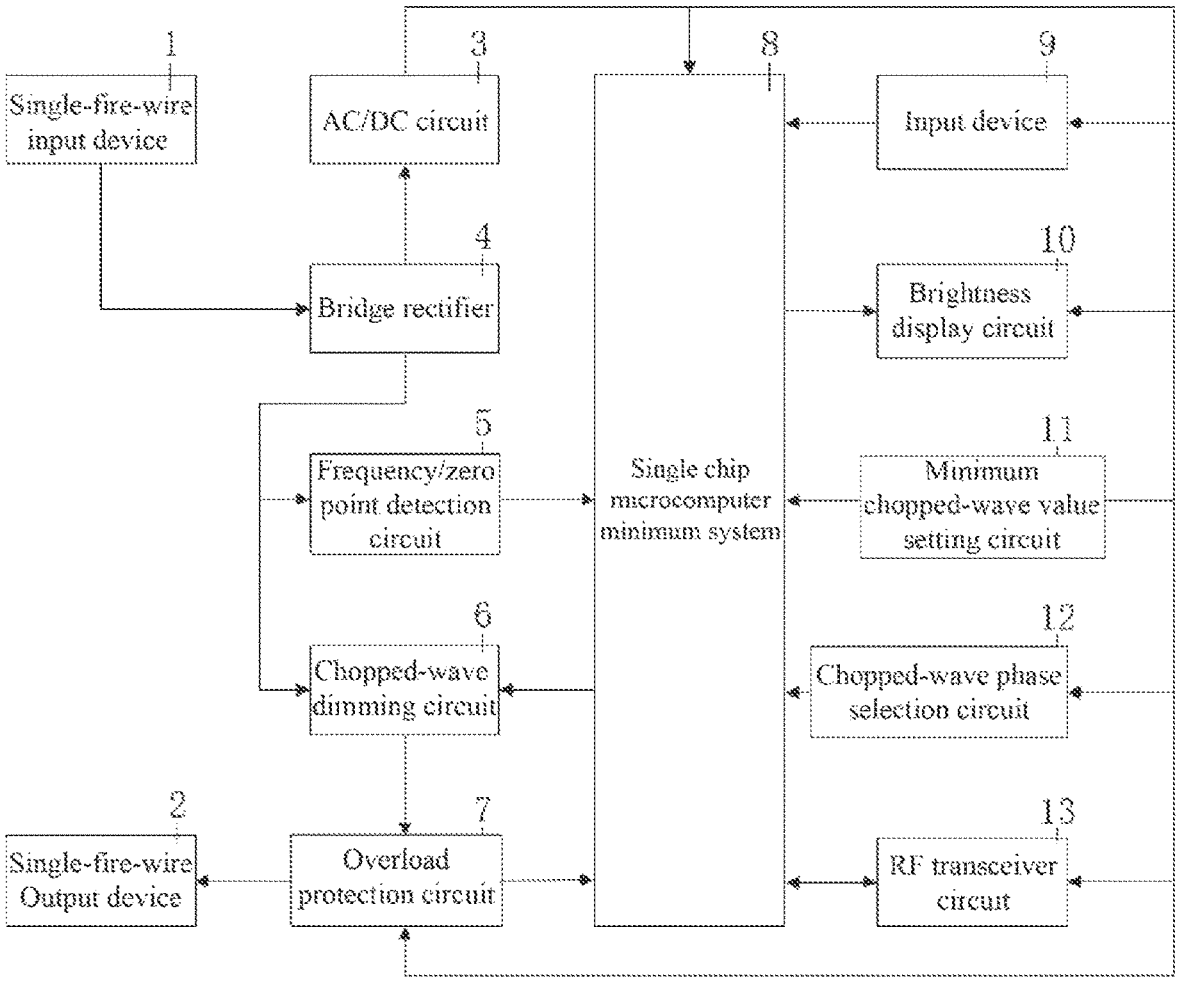
FIG. 1 is a schematic circuit block diagram of this invention.
Figure 2:
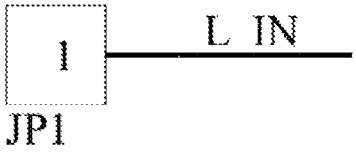
FIG. 2 is a schematic circuit diagram of a single-fire-wire input device of this invention.
Figure 3:
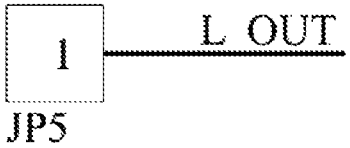
FIG. 3 is a schematic circuit diagram of a single-fire-wire output device of this invention.
Figure 4:
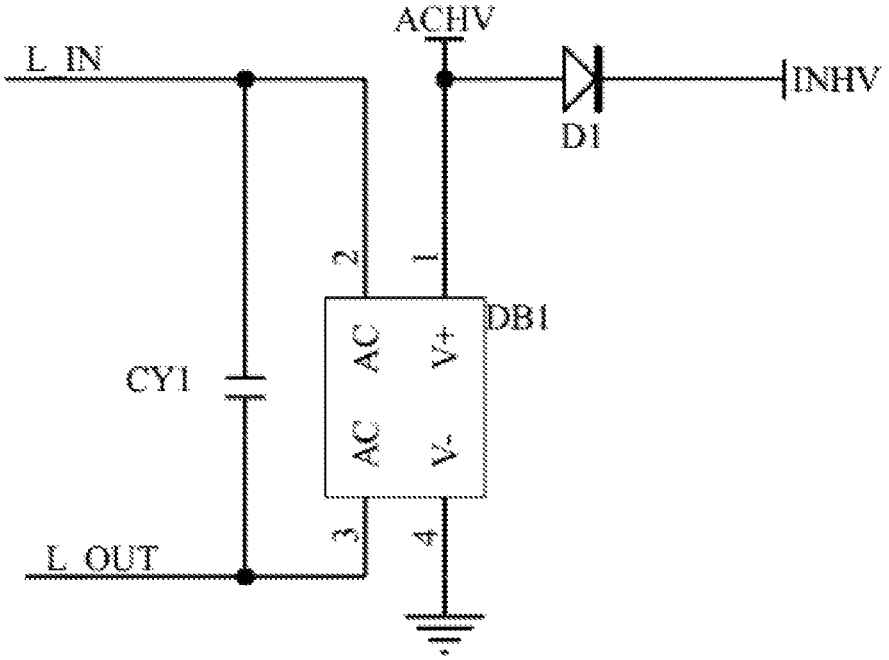
FIG. 4 is a schematic circuit diagram of an AC/DC circuit of this invention.
Figure 5:
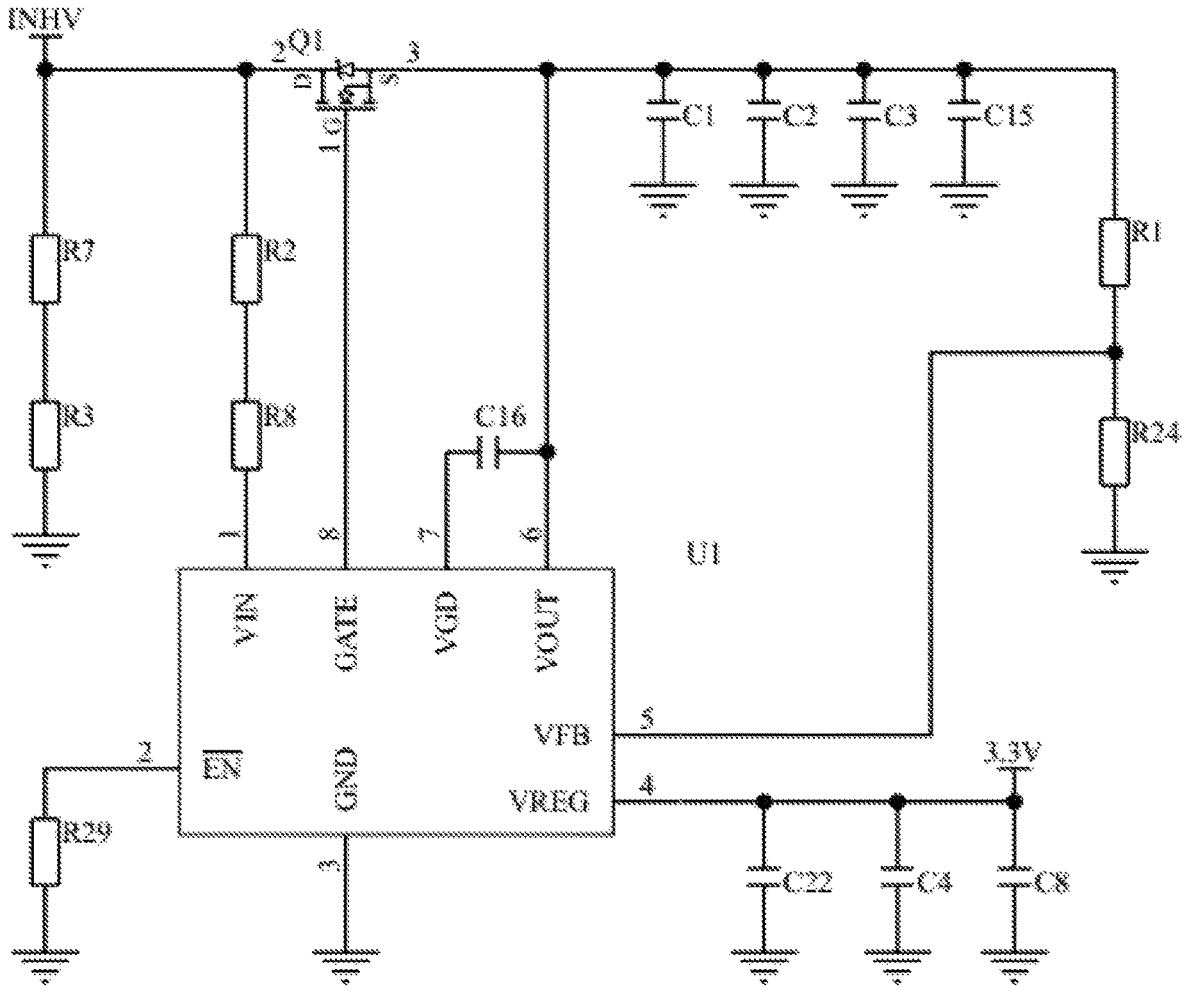
FIG. 5 is a schematic circuit diagram of a bridge rectifier of this invention.
Figure 6:
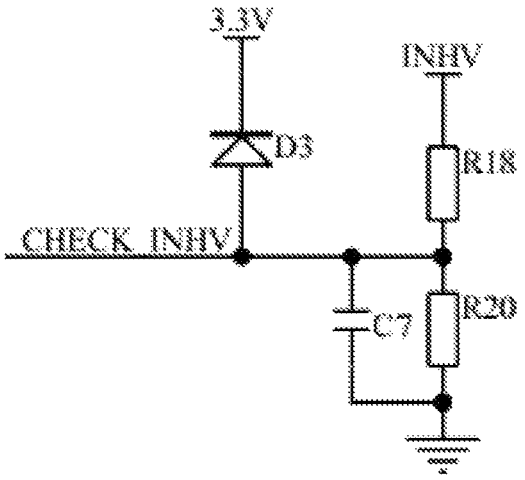
FIG. 6 is a schematic circuit diagram of a frequency/zero point detection circuit of this invention.
Figure 7:
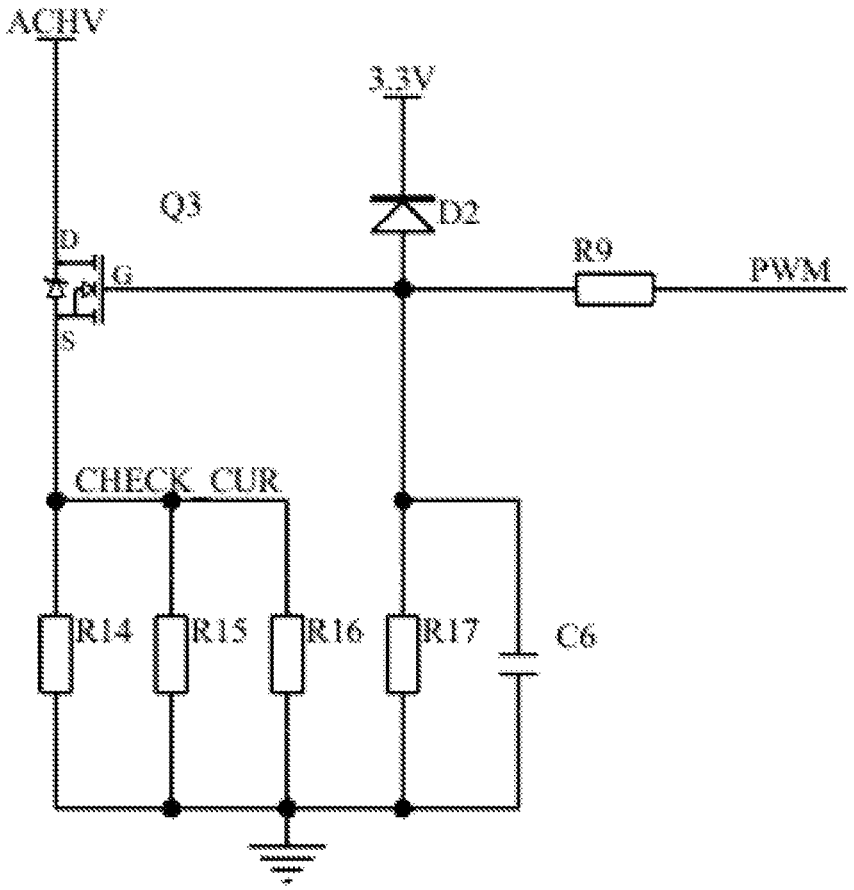
FIG. 7 is a schematic circuit diagram of a chopped-wave dimming circuit of this invention.
Figure 8:
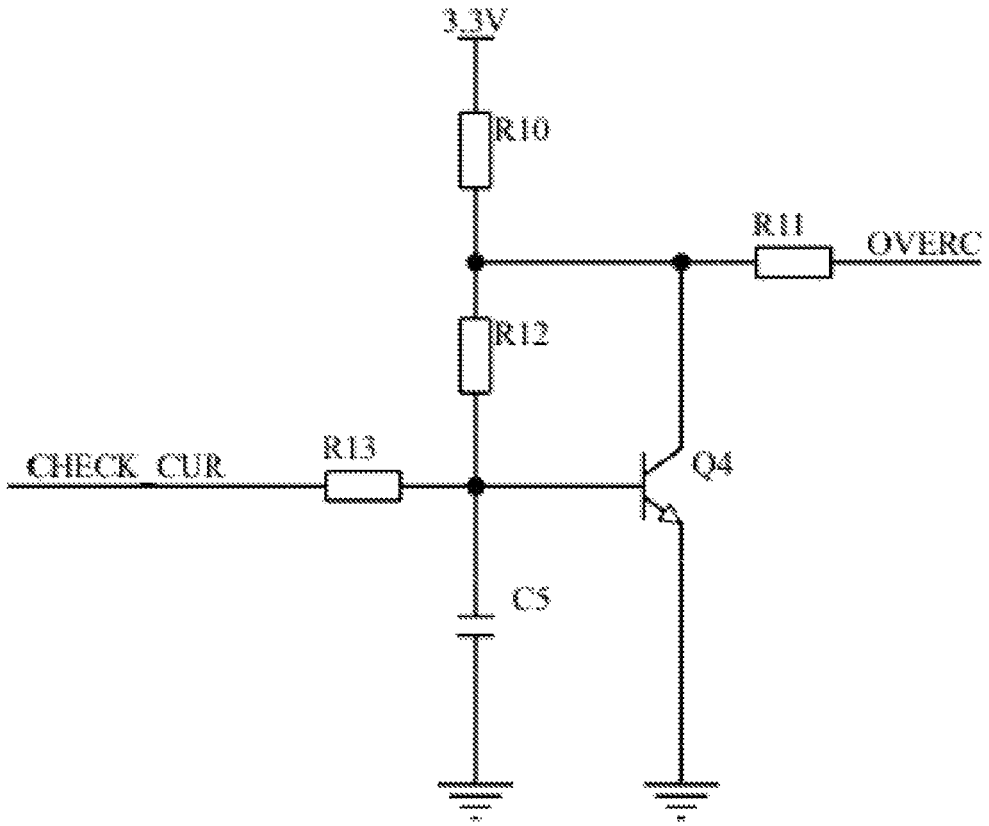
FIG. 8 is a schematic circuit diagram of an overload protection circuit of this invention.
Figure 9:
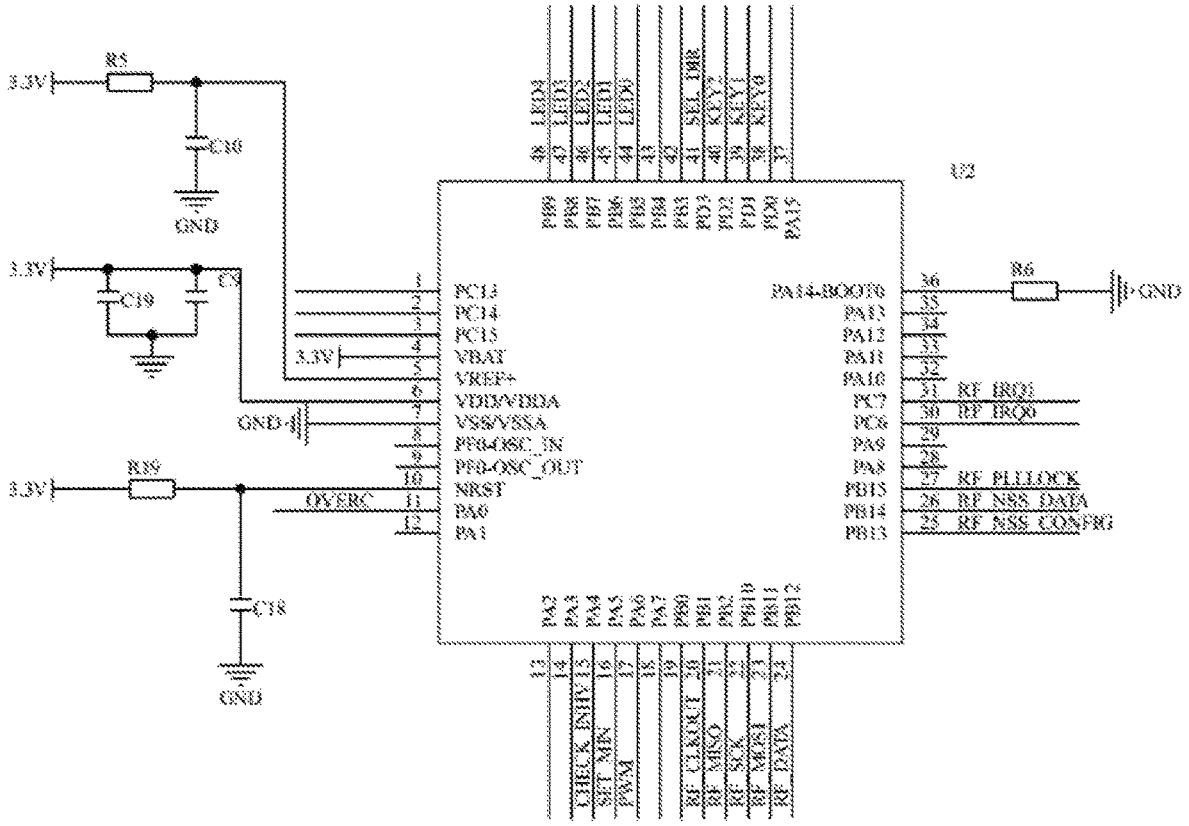
FIG. 9 is a schematic circuit diagram of a single chip microcomputer minimum system of this invention.
Figure 10:
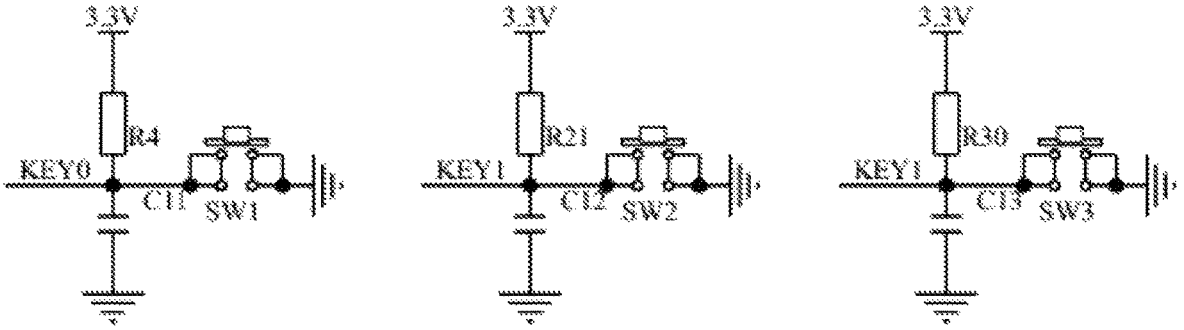
FIG. 10 is a schematic circuit diagram of an input device of this invention.
Figure 11:
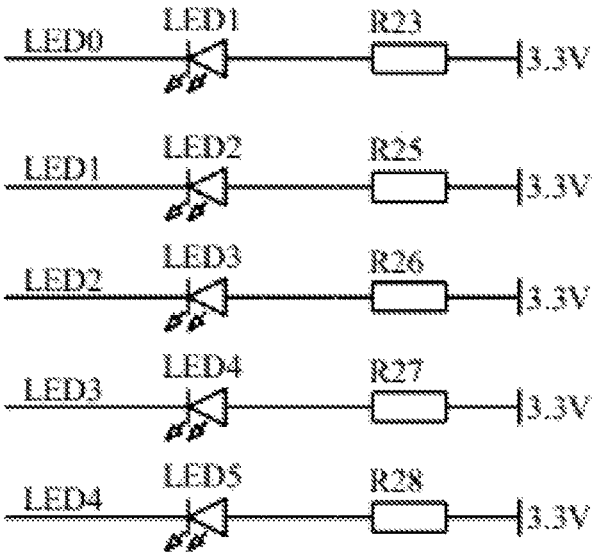
FIG. 11 is a schematic circuit diagram of a brightness display circuit of this invention.
Figure 12:
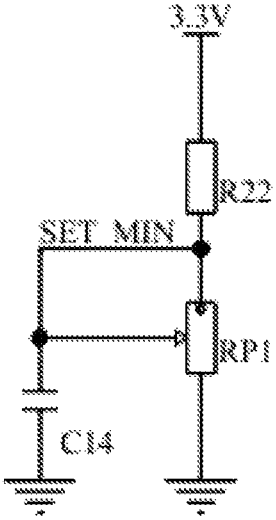
FIG. 12 is a schematic circuit diagram of a minimum chopped-wave value setting circuit of this invention.
Figure 13:
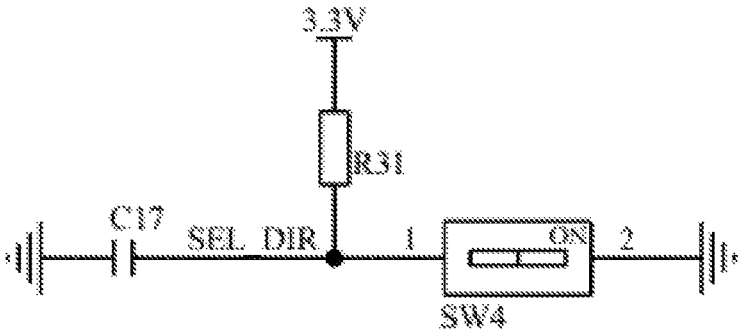
FIG. 13 is a schematic circuit diagram of a chopped-wave phase selection circuit of this invention.
Figure 14:
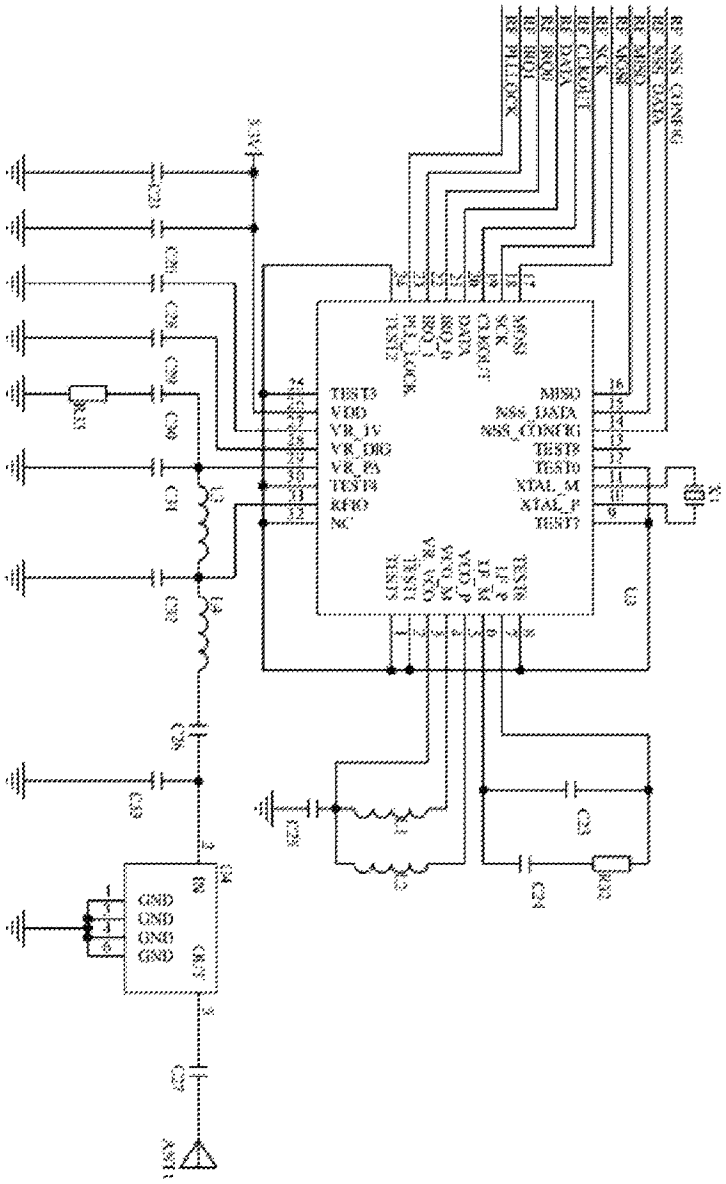
FIG. 14 is a schematic circuit diagram of a RF transceiver circuit of this invention.

With reference to FIGS. 1 to 14 for a single-fire-wire TRIAC wireless smart dimmer of the present invention, the single-fire-wire TRIAC wireless smart dimmer includes a single-fire-wire input device 1, a single-fire-wire output device 2, an AC/DC circuit 3, a bridge rectifier 4, a frequency/zero point detection circuit 5, a chopped-wave dimming circuit 6, an overload protection circuit 7, a single chip microcomputer minimum system 8, an input device 9, a brightness display circuit 10, a minimum chopped-wave value setting circuit 11, a chopped-wave phase selection circuit 12, and a RF transceiver circuit 13. The single-fire-wire input device 1 is connected to the bridge rectifier 4; the single-fire-wire output device 2 is connected to the overload protection circuit 7; the AC/DC circuit 3 is connected to the bridge rectifier 4, the overload protection circuit 7, the single chip microcomputer minimum system 8, the input device 9, the brightness display circuit 10, the minimum chopped-wave value setting circuit 11, the chopped-wave phase selection circuit 12, and the RF transceiver circuit 13; the bridge rectifier 4 is connected to the frequency/zero point detection circuit 5 and the chopped-wave dimming circuit 6; the frequency/zero point detection circuit 5 is connected to the single chip microcomputer minimum system 8; the chopped-wave dimming circuit 6 is connected to the overload protection circuit 7 and the single chip microcomputer minimum system 8; the overload protection circuit 7 is connected to the single chip microcomputer minimum system 8, the input device 9, the brightness display circuit 10, the minimum chopped-wave value setting circuit 11, the chopped-wave phase selection circuit 12 and the RF transceiver circuit 13; and the single chip microcomputer minimum system 8 is connected to the input device 9, the brightness display circuit 10, the minimum chopped-wave value setting circuit 11, the chopped-wave phase selection circuit 12 and the RF transceiver circuit 13.

Both of the single-fire-wire input device 1 and the single-fire-wire output device 2 are applicable to an alternating current of 50 HZ or 60 HZ; the bridge rectifier 4 includes a rectifier pile or a diode, capable of converting the alternating current of 50 HZ or 60 HZ from a sine wave into a square wave; the AC/DC circuit 3 is provided for supplying power for the operation of the dimmer and includes an integrated AC/DC chip or a discrete component to implement an AC/DC function; the frequency/zero point detection circuit 5 is provided for distinguishing the frequency of the inputted alternating current and determining the zero-crossing point and has a high/low level or ADC detection function; the chopped-wave dimming circuit 6 includes a MOS or an IGBT which the chopped-wave dimming circuit with the TRIAC part; the overload protection circuit 7 is a protection circuit for preventing the dimmer from being overloaded and includes a high/low level or ADC detector; the single chip microcomputer minimum system 8 is provided for obtaining, calculating, processing and controlling data; the input device 9 for obtaining an operation input includes a button module or a touch module; the brightness display circuit 10 is provided for displaying the current brightness percentage; the minimum chopped-wave value setting circuit 11 includes a switch dial or a potentiometer capable of setting a minimum chop wave value; the chopped-wave phase selection circuit 12 includes a switch dial or a potentiometer for selecting the phase of a leading edge chop wave or a trailing edge chop wave; and the RF transceiver circuit 13 has an infrared, Bluetooth (with frequencies of 433M and 2.4G respectively) wireless transmitting and receiving smart control.

In an embodiment of this invention, the single-fire-wire power taking method is capable of maintaining the normal operation of the whole dimmer, overcoming the issue of supplying insufficient currents for the normal operation of the wireless transmission and receiving, selecting the phase of a chop wave (such as a leading edge chip wave or a trailing edge chop wave), providing better compatibility for other power supplies, setting a minimum chop wave value, providing an overload protection, and displaying the brightness display percentage.

What is claimed is:

1. A single-fire-wire TRIAC wireless smart dimmer, comprising a single-fire-wire input device (1), a single-fire-wire output device (2), an AC/DC circuit (3), a bridge rectifier (4), a frequency/zero point detection circuit (5), a chopped-wave dimming circuit (6), an overload protection circuit (7), a single chip microcomputer minimum system (8), an input device (9), a brightness display circuit (10), a minimum chopped-wave value setting circuit (11), a chopped-wave phase selection circuit (12), and a RF transceiver circuit (13), characterized in that the single-fire-wire input device (1) is coupled to the bridge rectifier (4); the single-fire-wire output device (2) is coupled to the overload protection circuit (7); the AC/DC circuit (3) is coupled to the bridge rectifier (4), the overload protection circuit (7), the single chip microcomputer minimum system (8), the input device (9), the brightness display circuit (10), the minimum chopped-wave value setting circuit (11), the chopped-wave phase selection circuit (12) and the RF transceiver circuit (13); the bridge rectifier (4) is coupled to the frequency/zero point detection circuit (5) and the chopped-wave dimming circuit (6); the frequency/zero point detection circuit (5) is coupled to the single chip microcomputer minimum system (8); the chopped-wave dimming circuit (6) is coupled to the overload protection circuit (7) and the single chip microcomputer minimum system (8); the overload protection circuit (7) is coupled to the single chip microcomputer minimum system (8), the input device (9), the brightness display circuit (10), the minimum chopped-wave value setting circuit (11), the chopped-wave phase selection circuit (12), and the RF transceiver circuit (13); and the single chip microcomputer minimum system (8) is coupled to the input device (9), brightness display circuit (10), the minimum chopped-wave value setting circuit (11), the chopped-wave phase selection circuit (12) and the RF transceiver circuit (13).

2. The single-fire-wire TRIAC wireless smart dimmer according to claim 1, wherein both of the single-fire-wire input device (1), single-fire-wire output device (2) are applicable to an alternating current of 50 HZ or 60 HZ, and the bridge rectifier (4) comprises a rectifier pile or a diode for converting the alternating current of 50 HZ or 60 HZ from a sine wave into a square wave, and the AC/DC circuit (3) supplies the power for the operation of the dimmer and comprises an integrated AC/DC chip or a discrete component to implement an AC/DC function, and the frequency/zero point detection circuit (5) is provided for distinguishing the frequency inputted alternating current and determining a zero-crossing point and has a high/low level or ADC detection function, and the chopped-wave dimming circuit (6) comprises a MOS or an IGBT which is the chopped-wave dimming circuit with the TRIAC part, and the overload protection circuit (7) is a protection circuit for preventing the dimmer from being overloaded and comprises a high/low level or ADC detector, and the single chip microcomputer minimum system (8) is provided for obtaining, calculating and processing data, and the input device (9) is provided for inputting an operation and comprises a button module or a touch module, and the brightness display circuit (10) is provided for displaying a current brightness percentage, and the minimum chopped-wave value setting circuit (11) comprises a switch dial or a potentiometer for setting a minimum chop wave value, and the chopped-wave phase selection circuit (12) comprises a switch dial or a potentiometer for selecting the phase of a leading edge chop wave or a trailing edge chop wave, and the RF transceiver circuit (13) has an infrared, Bluetooth, or wireless transmitting and receiving smart control.

* * * * *